US006135730A

United States Patent [19]

Yoshioka

[11] Patent Number: 6,135,730

[45] Date of Patent: Oct. 24, 2000

[54] ELECTRIC FUEL PUMP

[75] Inventor: Hiroshi Yoshioka, Tokyo, Japan

[73] Assignee: Mitsubishi Denki Kabushiki Kaisha, Tokyo, Japan

[21] Appl. No.: 09/156,597

[22] Filed: Sep. 18, 1998

[30] Foreign Application Priority Data

Feb. 19, 1998 [JP] Japan ..... 10-037143

[51] Int. Cl.[7] ..... F04B 17/00; F04B 35/04

[52] U.S. Cl. ..... 417/423.1; 417/423.14; 415/55.1

[58] Field of Search ..... 417/423.3, 423.11, 417/423.14, 423.1; 415/55.1

[56] References Cited

U.S. PATENT DOCUMENTS 4,784,587 11/1988 Takei et al. ..... 417/423.6
4,872,806 10/1989 Yamada et al. ..... 415/55.5
4,915,582 4/1990 Nishikawa ..... 415/55.1
5,391,062 2/1995 Yoshioka ..... 417/423.3

*Primary Examiner*—Henry C. Yuen
*Assistant Examiner*—Mahmoud M. Gimie
*Attorney, Agent, or Firm*—Sughrue, Mion, Zinn, Macpeak & Seas, PLLC

[57] ABSTRACT

The provision of an electric fuel pump in which the rotational frictional resistance between the pump casing and the impeller is made small to prevent the decrease of the motor rotational number and the increase of the current consumption and in which the discharge efficiency is improved. In a pump casing 17 supporting the impeller 1 by the sliding surface 3*a* of the pump base 3 and the sliding surface 16*a* of the pump cover 16 and at the inner circumference side of the pump chamber 4 in the vicinity of the side 6*a* opposing to the pump chamber outlet 6 of the sliding surface 16*a* of the pump cover 16, the provision is made of an abutment relief portion 16*b* having a gap larger than said small gap, and a stepped side wall 16*c* defined at an end portion 19 downstream of the side of said abutment relief portion 16*b* opposing to said pump chamber outlet 6.

9 Claims, 9 Drawing Sheets

ELECTRIC FUEL PUMP

BACKGROUND OF THE INVENTION

This invention relates to an electric fuel pump in which the fuel pump and the fuel filter disposed within a fuel tank of a vehicle or the like are arranged in an integral structure.

FIG. 14 is a side view showing partly in section a conventional electric fuel pump disclosed in U.S. Pat. No. 5,391,062. FIG. 15 is a sectional view taken along line XV—XV of FIG. 14. FIG. 16 is a sectional view taken along line XVI—XVI of FIG. 15. FIG. 17 is a plan view showing a pump cover to which no abutment relief portion is provided.

In the figures 1 is an impeller of a disc-shape having formed in its outer peripheral portion a plurality of vane groove portions 1*a* extending in radial direction, 2 is a pump cover having a sliding surface 2*a* opposing to one side surface 1*b* of the impeller 1 with a small gap therebetween and supporting the impeller 1, 3 is a pump base having a sliding surface 3*a* opposing to the other side surface 1*c* of the impeller 1 with a small gap therebetween and supporting the impeller 1. 4 is a pump chamber of an arcuate belt shape extending along the outer peripheral portion of the impeller 1 at the outer side of the sliding surface 2*a* of the pump cover 2 and the sliding surface 3*a* of the pump base 3, and 4*a* is an inner side wall of the inner and the outer sides of the pump chamber 4. 5 is a fuel suction port disposed to the side of the pump cover 2 and 6 is a pump chamber outlet disposed to the side of the pump base 3. It is to be noted that pump casing 7 is composed of the pump cover 2, the pump base 3, the pump chamber 4, the fuel suction port 5 and the pump chamber outlet 6.

Also, as shown in FIGS. 15 and 16, a gap larger than the small gap defined in connection with the impeller 1 is provided in the inner circumferential side of the pump chamber 4 in the vicinity of the side 6*a* opposite to the pump chamber outlet 6 of the sliding surface 2*a* of the pump cover 2 as an abutment relief portion 2*b* with respect to the impeller 1, the end portion of the abutment relief portion 2*b* has a tapered portion 2*c* of a very gentle slope. In one embodiment, the angle θ (shown in FIG. 16) of the tapered portion 2*c* is about 168°. 8 shown in FIG. 14 is a motor shaft to which the impeller 1 is fitted, 9 is an armature and 10 is a magnet. 11 is a cylindrical housing or an outer sheath which mounts the magnet 10 and to which the pump casing 7 is fitted thereon. It is to be noted that a motor portion 12 is composed of the motor shaft 8, the armature 9, the magnet 10 and the housing 11. 13 is a motor chamber of the motor portion 12 and 14 is a fuel discharge port.

In the conventional electric fuel pump having the above-explained structure, when the motor portion 12 is operated, the impeller 1 rotates to suck the fuel (not shown) from the fuel suction port 5, the sucked fuel being pressure-increased in the pump chamber 4, introduced through the pump chamber outlet 6 into the motor chamber 13 and discharged to the outside through the fuel discharge port 14.

In the conventional electric fuel pump of the foregoing arrangement, a leakage loss generates within the gap defined between the side surfaces 1*b*, 1*c* of the impeller 1 and the sliding surfaces 2*a*, 3*a* of the pump cover 2 and the pump base 3 contacting to the side surfaces 1*b*, 1*c* and between the side 6*a* opposing to the pump chamber outlet 6 and the fuel suction port 5, i.e., the dam portion 2*a* -1. In order to prevent the decrease of the discharge efficiency of the pump due to this leakage loss, the gap in the thrust direction between the side surfaces 1*b*, 1*c* of the impeller 1 and the sliding surfaces 2*a*, 3*a* is made very small. Therefore, when the fuel pressure within the pump chamber 4 is increased due to the rotation of the vane grooves 1*a* toward the pump chamber outlet port 6 from the fuel suction port 5, the impeller 1 tends to be brought into contact with the position f the sliding surface 2*a* of the pump cover 2 in the vicinity of the side 6*a* opposing to the pump chamber outlet 6 in the pump casing 7 by the pressure unbalance between that about the pump chamber outlet 6 in the pump casing 7 and the fuel suction port 5 in the pump casing 7. When no abutment relief portion 2*b* is provided in the pump cover 2, as shown in FIG. 17, the sliding surface 2*a* of the pump cover 2 around the side 6*a* opposing to the pump chamber outlet 6 of the pump casing 7 is subjected to generation of sliding scares 15. In the conventional apparatus, the abutment relief portion 2*b* is provided at this region thereby to try to prevent the contact of the impeller 1.

However, as shown in FIG. 15, the dam portion 2*a* -1 is disposed only in the intermediate portion of the side 6*a* opposing to the pump chamber outlet 6 and the fuel suction port 5 in order to prevent decrease of the discharge efficiency of the pump due to the leakage loss generated between the side 6*a* opposing to the pump chamber outlet 6 and the fuel suction port 5. Therefore, at the position of the dam portion 2*a* -1 where no abutment relief portion 2*b* is provided, the impeller 1 is brought into contact with the pump casing 7. As a result, the rotation frictional resistance of the impeller 1 increases, the rotation of the motor 12 decreases and the electric current consumption increases, whereby the discharge efficiency of the electric fuel pump is disadvantageously decreases.

SUMMARY OF THE INVENTION

This invention has been made in order to solve the above-discussed problem and has as its object the provision of an electric fuel pump in which the contact between the impeller and the pump casing is alleviated in which the rotation friction resistance is small.

The electric fuel pump of the present invention comprises an impeller having a vane groove portion at its outer circumferential portion of a disc-shape, a motor portion for rotation-driving the impeller, a pump casing disposed in opposition to the opposite side surfaces of the impeller with a small gap therebetween to define a sliding surface supporting the impeller, defining an arcuate belt-shaped pump chamber extending along the outer circumferential portion of the impeller around the sliding surface and having a fuel suction port at one end portion of the arcuate belt-shaped chamber and a pump chamber outlet at the other end portion, an abutment relief portion disposed in said pump casing at the inner circumference side of said pump chamber in the vicinity of the side opposing to said pump chamber outlet, said abutment relief portion having a gap larger than said small gap, and a stepped side wall defined at an end portion downstream of the side of the abutment relief portion opposing to the pump chamber outlet.

Also, the inner circumference of the abutment relief portion has a configuration such that, in the direction of rotation of the impeller, the radius from the rotational center of the impeller gradually increases and that a stepped side wall is provided at the end portion of the inner circumferential side of the abutment relief portion.

Also, a gap larger than the small gap is defined in the vicinity of the fuel suction port of the sliding surface on the side opposing to the pump chamber outlet of the pump casing and wherein a stepped side wall is disposed in the gap at the end portion downstream of a starting end portion of the pump chamber.

Also, the inner circumference of the abutment relief portion is such that, in the direction of rotation of the impeller, the radius from the rotational center of the impeller gradually increases and that a stepped side wall is provided at the end portion of the inner circumferential side of the abutment relief portion.

Also, a stepped side wall is provided at the end portion of the inner circumferential side of the abutment relief portion.

Also, the angle of the inner side wall of the arcuate belt-shaped pump chamber disposed in the pump casing and the angle of at least one of the stepped side walls of the abutment relief portion and the gap portion are the same angles.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Embodiment 1.

Figure 1:
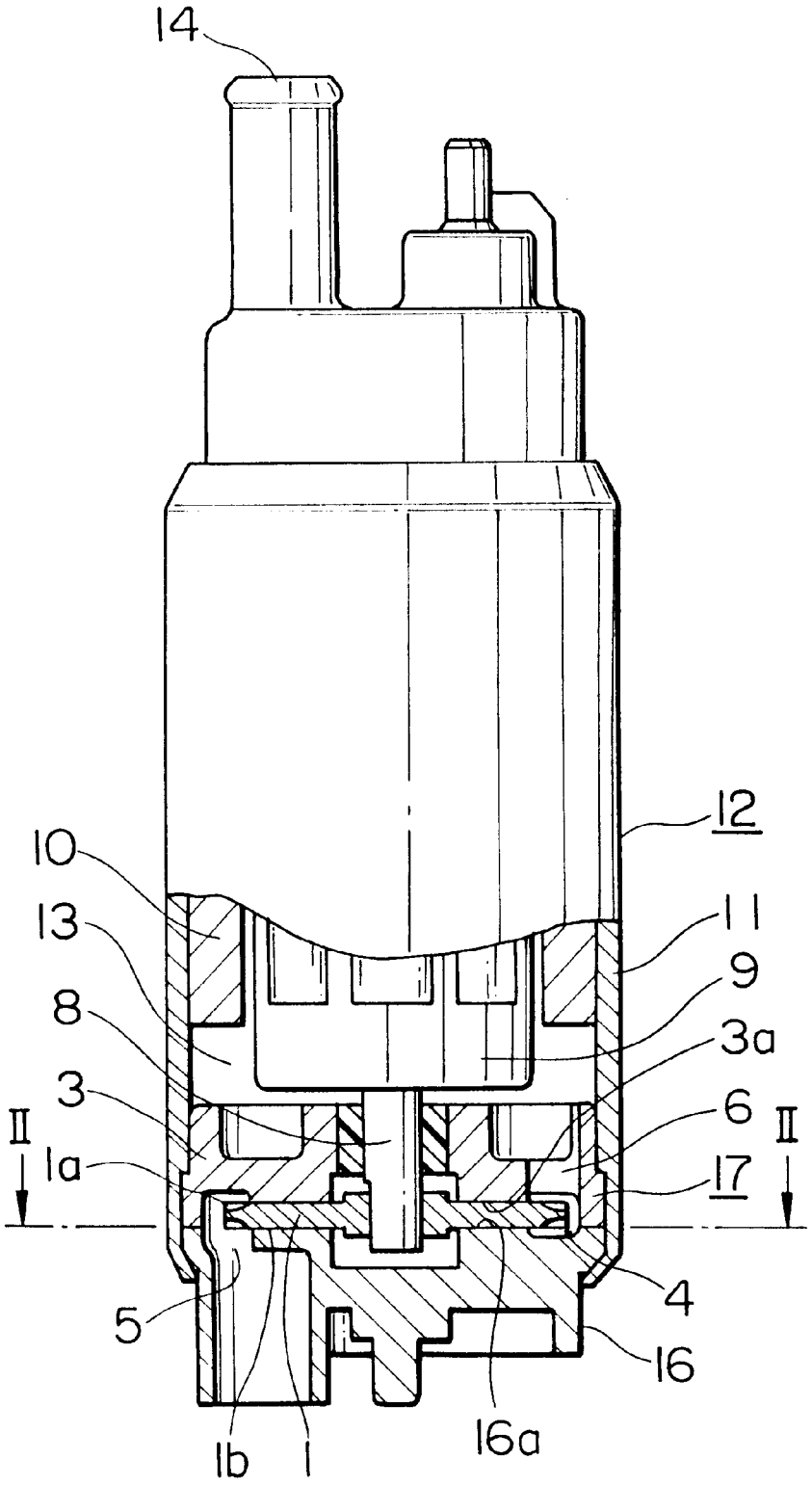
FIG. 1 is a partly cut away side view of the electric fuel pump of the first embodiment of the present invention supply apparatus of the first embodiment of the present invention.
Figure 2:
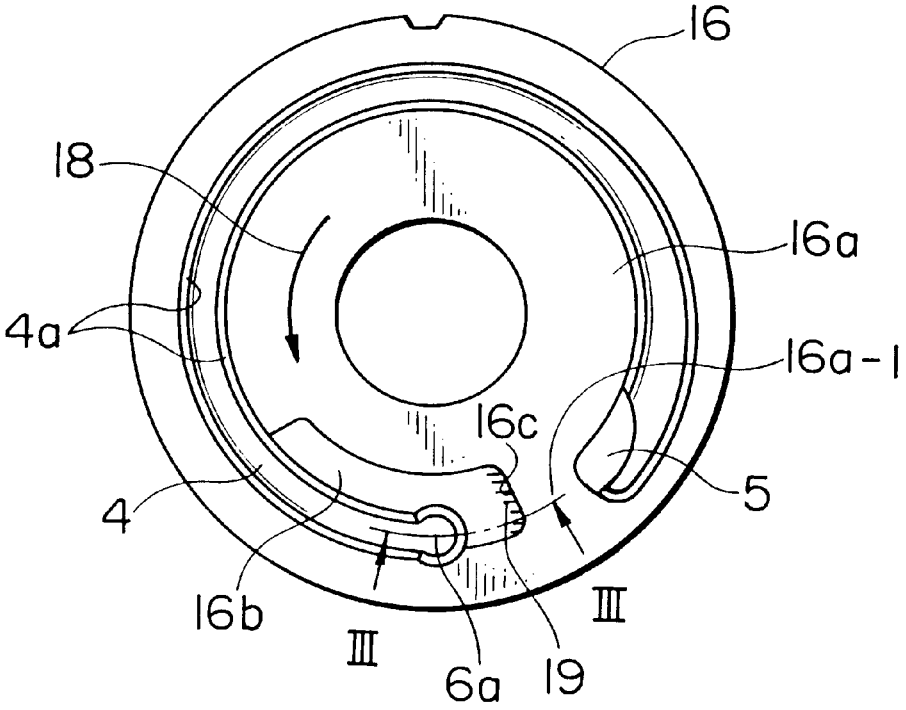
FIG. 2 is a plan view showing the pump cover taken along the line II—II of FIG. 1.
Figure 3:
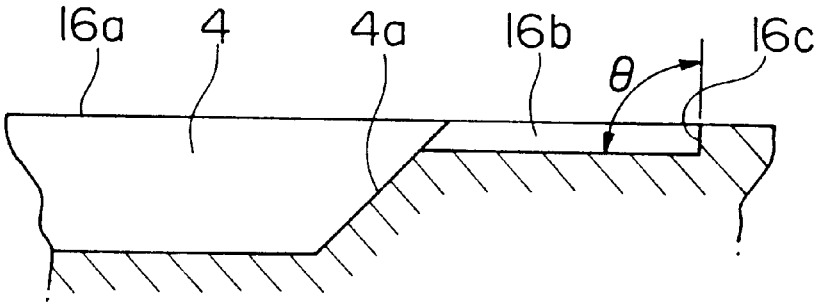
FIG. 3 is an enlarged sectional view taken along the line III—III of FIG. 2.
Figure 4:
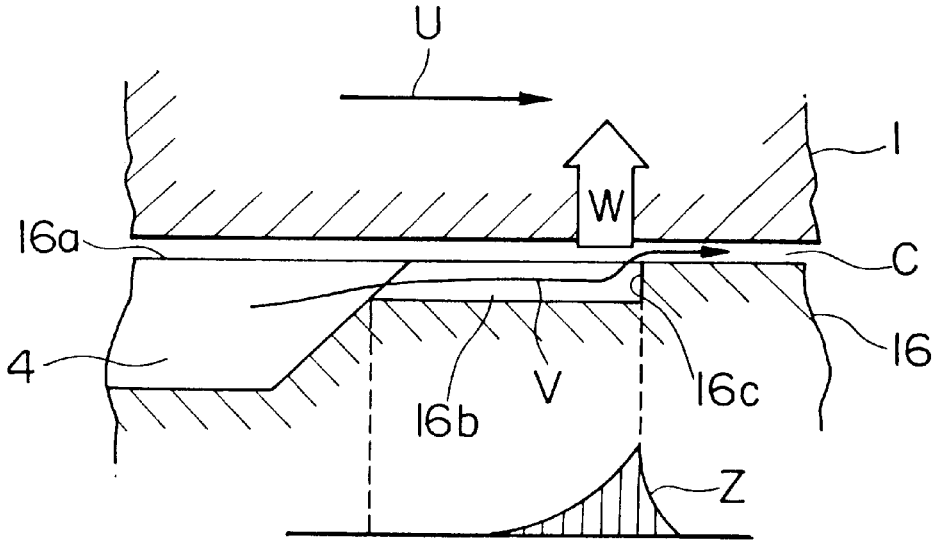
FIG. 4 is a view for explaining the advantageous results of the stepped side wall side wall of the pump cover of the electric fuel pump of the present invention.

FIG. 1 is a side view showing partly in section an electric fuel pump of the first embodiment of the present invention. FIG. 2 is a sectional view showing the pump cover as viewed along line II—II of FIG. 1. FIG. 3 is an enlarged sectional view taken along line III—III of FIG. 2. FIG. 4 is a view for explaining the advantageous results of the stepped side wall of the pump cover. In the figures 1, 1*a*, 3, 4–6, 6*a*, 8–14 are the components similar to those of the above conventional apparatus and their explanation will be omitted.

16 is a pump cover, which has a sliding surface 16*a* disposed in opposition to one side surface 1*b* of the impeller 1 with a small gap defined therebetween and supporting the impeller 1. A gap larger than the above small gap between the impeller 1 and the sliding surface 16*a* is defined in communication with the inner side wall 4*a* of the sliding surface 16*a* on the inner circumferential side of the pump chamber 4 in the vicinity of the side 6*a* opposing to the pump chamber outlet 6, this gap being an abutment relief portion 16*b* in relation to the impeller 1. A stepped side wall 16*c* (shown in FIG. 3) is disposed at a downstream end portion 19 of the fuel flow of the side 6*a* opposing to the pump chamber outlet 6 of the abutment relief portion 16*b*, i.e., at a position (shaded portion in FIG. 2) opposing to the rotational direction 18 of the impeller 1. The angle θ of this stepped side wall 16*c* is preferably in a range between 90 degrees and 135 degrees according to the results of various experiments with different angles.

While the configuration of this abutment relief portion 16*b* is made coincide with the position of the slide scratches 15 on the pump cover 2 generated by the contact with the impeller 1, as far as the dam portion 16*a* -1 is concerned, it is disposed only up to the intermediate portion between the fuel suction port 5 and the side 6*a* opposite to the pump chamber outlet 6 in order to prevent the pump discharge efficiency from being decreased due to the leakage loss generated between the fuel suction port 5 and the side 6*a* opposing to the pump chamber outlet 6. Such the pump cover 16 and the pump base 3 are combined to define a pump casing 17 having a pump chamber 4 therein.

As shown in FIG. 4, when the pump cover 16 which is a stationary wall of the pump casing 17 and the impeller 1 which is a movable wall are opposed to each other with a small gap C interposed therebetween and the impeller 1 made rotational movement in the direction of an arrow U, a flow of fuel (shown by an arrow V) in the same direction as the arrow U is generated within the abutment relief portion 16*b* due to the viscosity of the fuel. This flow of the fuel impinges against the stepped side wall 16*c* disposed at the terminal end portion of the abutment relief portion 16*b* as viewed in the flow direction of the fuel to flow into the small gap C, so that a local pressure built up is generated in the vicinity of the stepped side wall 16*c*. This pressure generates a load W in the direction which tends to move the impeller 1 away from the sliding surface 16*a* of the pump cover 16. At this time, the distribution profile of the pressure acting on the opposing surface of the impeller 1 opposing to the abutment relief portion 16*b* in the vicinity of the stepped side wall 16*c* is as shown in a curve Z (shown in FIG. 4).

In the electric fuel pump of the above construction, when the motor portion 12 is operated, the impeller 1 rotates to suck the fuel (not shown) from the fuel inlet 5, and the sucked fuel is pressurized in the pump chamber 4, enters into the motor chamber 13 through the pump chamber outlet 6 and discharged to the outside through the fuel discharge port 14. At this time, the impeller 1 tends to be brought into contact with the side 6*a* of the sliding surface 16*a* opposing to the pump chamber outlet 6 due to the pressure unbalance within the pump chamber 4.

However, the provision is made of a gap larger than the small gap C between the impeller 1 and the sliding surface 16*a* and communicated with the inner side wall 4*a* on the inner circumferential side of the pump chamber 4 in the vicinity of the side 6*a* opposing to the pump chamber outlet 6 of the sliding surface 16*a* of the pump casing 17 and this gap being used as the abutment relief portion 16*b*. Also, the stepped side wall 16*c* is provided at the end portion of the abutment relief portion 16*b*, the pressure generated at this stepped side wall 16*c* functions to lift the impeller 1 in the direction away from the sliding surface 16*a*. Therefore, the contact between the pump cover 16 constituting the pump casing 17 and the impeller 1 is alleviated, resulting in a small rotation frictional resistance.

Embodiment 2.

Figure 5:
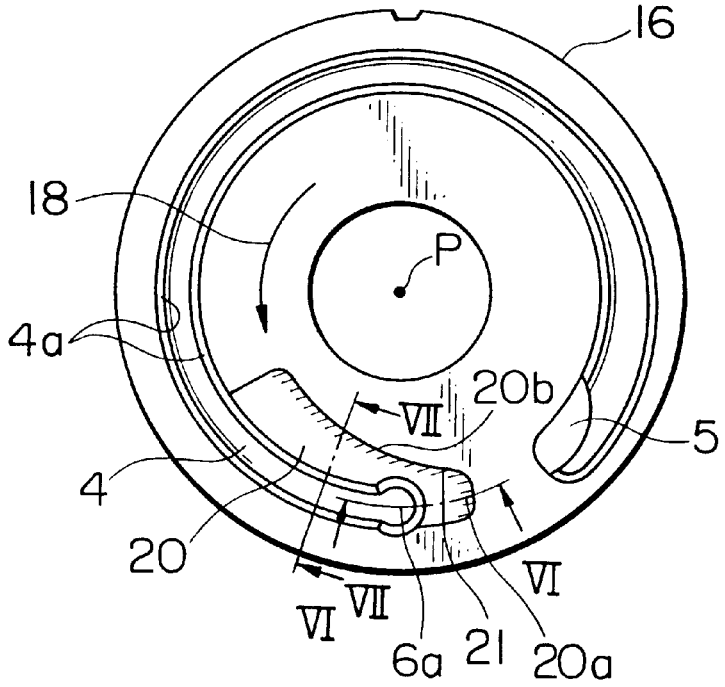
FIG. 5 is a plan view showing the pump cover of the second embodiment of the present invention.
Figure 6:
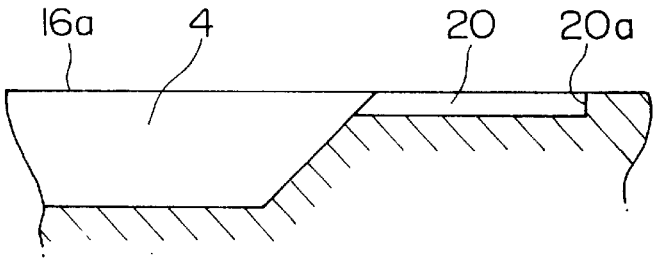
FIG. 6 is an enlarged section view taken along the line VI—VI of FIG. 5.
Figure 7:
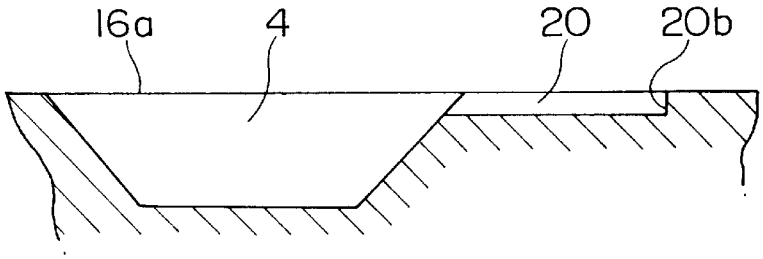
FIG. 7 is an enlarged section view taken along the line VII—VII of FIG. 5.

FIG. 5 is a plan view of the pump cover showing the second embodiment of the present invention. FIG. 6 is an enlarged sectional view taken along the line VI—VI of FIG. 5. FIG. 7 is an enlarged sectional view taken along the line VII—VII of FIG. 5. In these figures 4, 5, 6*a*, 16, 16*a* and 18 are the components similar to those of the first embodiments, so that their explanation will be omitted.

A gap larger than the small gap between the impeller 1 and the sliding surface 16*a* is defined in communication with the inner side wall 4*a* on the inner circumferential side of the pump chamber 4 in the vicinity of the side 6*a* opposing to the pump chamber outlet 6 in the sliding surface 16*a* of the pump cover 16 constituting the pump casing 17, so that this gap serves as an abutment relief portion 20 in relation to the impeller 1, and stepped side walls 20*a*, 20*b* as shown in FIGS. 6 and 7 are disposed at an end portion 21 of the abutment relief portion 20, i.e., at a position (shaded portion in FIG. 5) opposing to the rotational direction 18 of the impeller 1. Also, the configuration of the inner circumferential side (the portion in which the stepped side wall 20*b* is provided) of the abutment relief portion 20 is such that the radius from the rotational center of the impeller 1 gradually increases in the direction of rotation 18 of the impeller 1.

With the electric fuel pump of such the structure, a pressure building-up effect similar to that explained in connection with the first embodiment in FIG. 4 can be obtained also on the inner circumferential side of the abutment relief portion 20 (the portion in which the stepped side wall 20*b* is provided), the impeller 1*c* an be more effectively lifted in the direction away from the sliding surface 16*a*, the contact between the pump cover 16 constituting the pump casing 17 and the impeller 1 is alleviated, resulting in a small rotation frictional resistance.

Embodiment 3.

Figure 8:
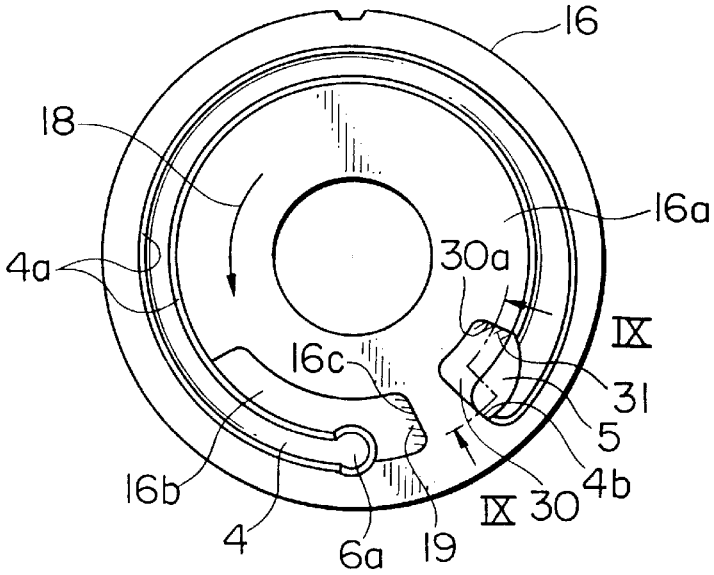
FIG. 8 is a plan view showing the pump cover of the second embodiment of the present invention.
Figure 9:
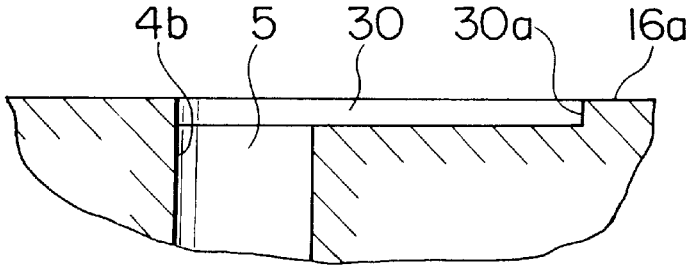
FIG. 9 is an enlarged section view taken along the line IX—IX of FIG. 8.

FIG. 8 is a plan view of the pump cover showing the third embodiment of the present invention. FIG. 9 is an enlarged sectional view taken along the line IX—IX of FIG. 8. In these figures 4, 5, 6*a*, 16, 16*a*, 16*b*, 16*c*, 18 and 19 are the components similar to those of the first embodiment, so that their explanation will be omitted.

In the sliding surface 16*a* of the pump cover 16 constituting the pump casing 17, in addition to the abutment relief portion 16*b* shown in the first embodiment, a gap portion 30 larger than the small gap between the impeller 1 and the sliding surface 16*a* is defined in communication with the inner side wall 4*a* on the inner circumferential side of the pump chamber 4 in the vicinity of the fuel suction port 5 in the sliding surface 16*a*, and a stepped side wall 30*a* is provided at a downstream end portion 19 of the fuel flow of the side 6*a* opposing to the pump chamber outlet 6 of the abutment relief portion 16*b*, i.e., at a position (shaded portion in FIG. 2) opposing to the rotational direction 18 of the impeller 1.

According to the electric fuel pump having such the structure, a pressure generation effect similar to that explained in connection with FIG. 4 concerning the first embodiment can be obtained even at the end portion 31 of the gap portion 30, so that the impeller 1 can more effectively be lifted in the direction away from the sliding surface 16*a*, alleviating the contact between the pump cover 16 constituting the pump casing 17 and the impeller 1, further decreasing the rotational frictional resistance.

It is to be noted that the above gap portion 30 can be combined with the abutment relief portion 20 defined by the gap shown in the second embodiment and a similar advantageous result can be obtained.

Embodiment 4.

Figure 10:
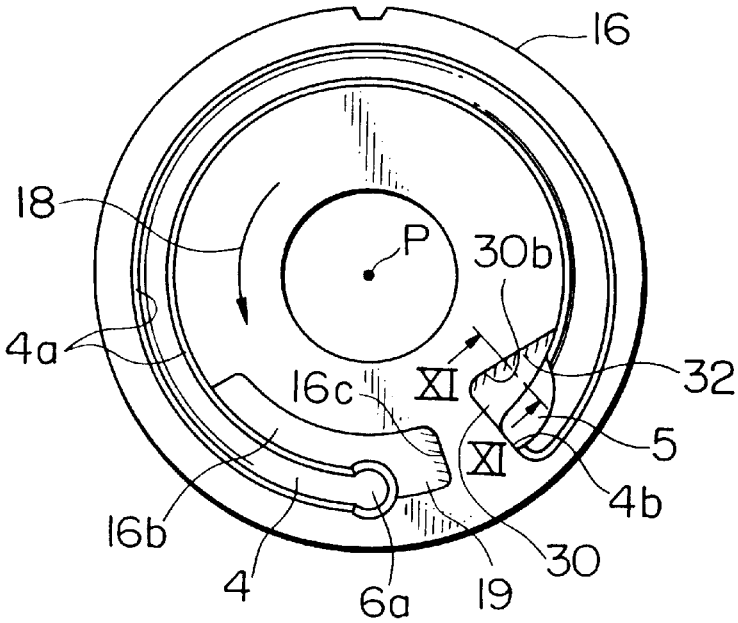
FIG. 10 is a plan view showing the pump cover of the fourth embodiment of the present invention.
Figure 11:
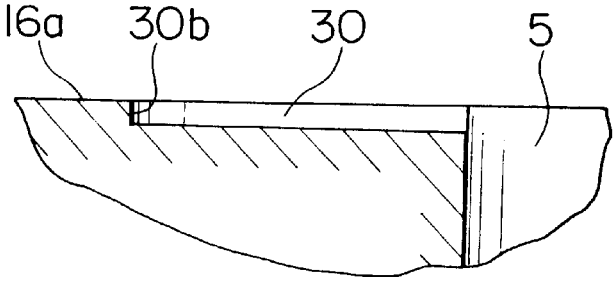
FIG. 11 is an enlarged section view taken along the line XI—XI of FIG. 10.

FIG. 10 is a plan view of the pump cover showing the fourth embodiment of the present invention. FIG. 11 is a sectional view taken along the line XI—XI of FIG. 10. In these figures 4, 5, 6*a*, 16, 16*a*, 16*b*, 16*c*, 18, 19 and 30 are components similar to those of the third embodiment, so that their explanation will be omitted.

The configuration of the inner circumferential side of the gap portion 30 defined in the sliding surface 16*a* of the pump cover 16 constituting the pump casing 17 is such that the radius from the rotational center P of the impeller 1 gradually increases in the direction of rotation 18 of the impeller 1 and it end portion 32 is provided with a stepped side wall 30*b*.

According to the electric fuel pump having such the structure, a pressure generation effect similar to that explained in connection with FIG. 4 concerning the first embodiment can be obtained even at the end portion 32 of the inner circumferential side of the gap portion 30, so that the impeller 1*c* an more effectively be lifted in the direction away from the sliding surface 16*a*, alleviating the contact between the pump cover 16 constituting the pump casing 17 and the impeller 1, further decreasing the rotational frictional resistance.

It is to be noted that the above gap portion 30 can be combined with the abutment relief portion 20 defined by the gap shown in the second embodiment and a similar advantageous result can be obtained.

Embodiment 5.

Figure 12:
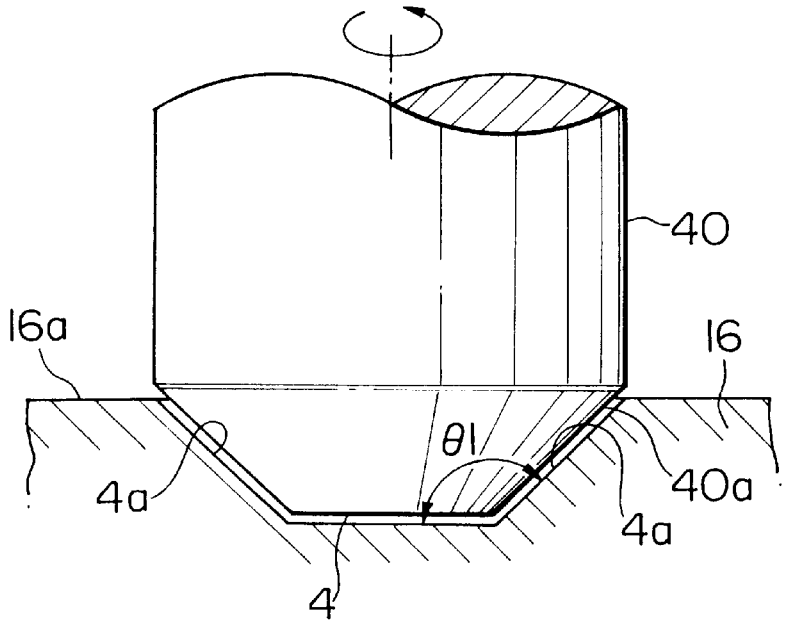
FIG. 12 is a manufacturing step view showing the step for manufacturing the pump casing of the fifth embodiment of the present invention.
Figure 13:
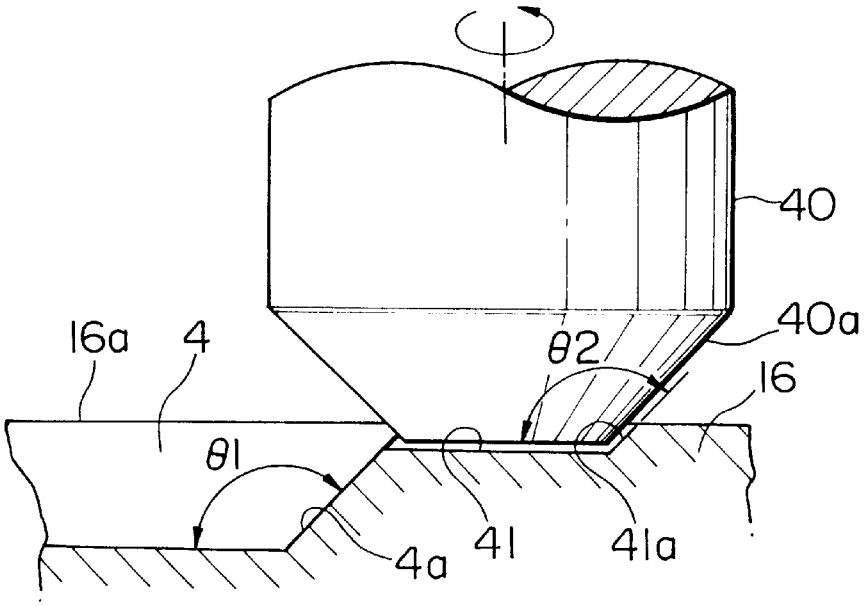
FIG. 13 is a manufacturing step view showing the step for manufacturing the pump casing of the fifth embodiment of the present invention.
Figure 14:
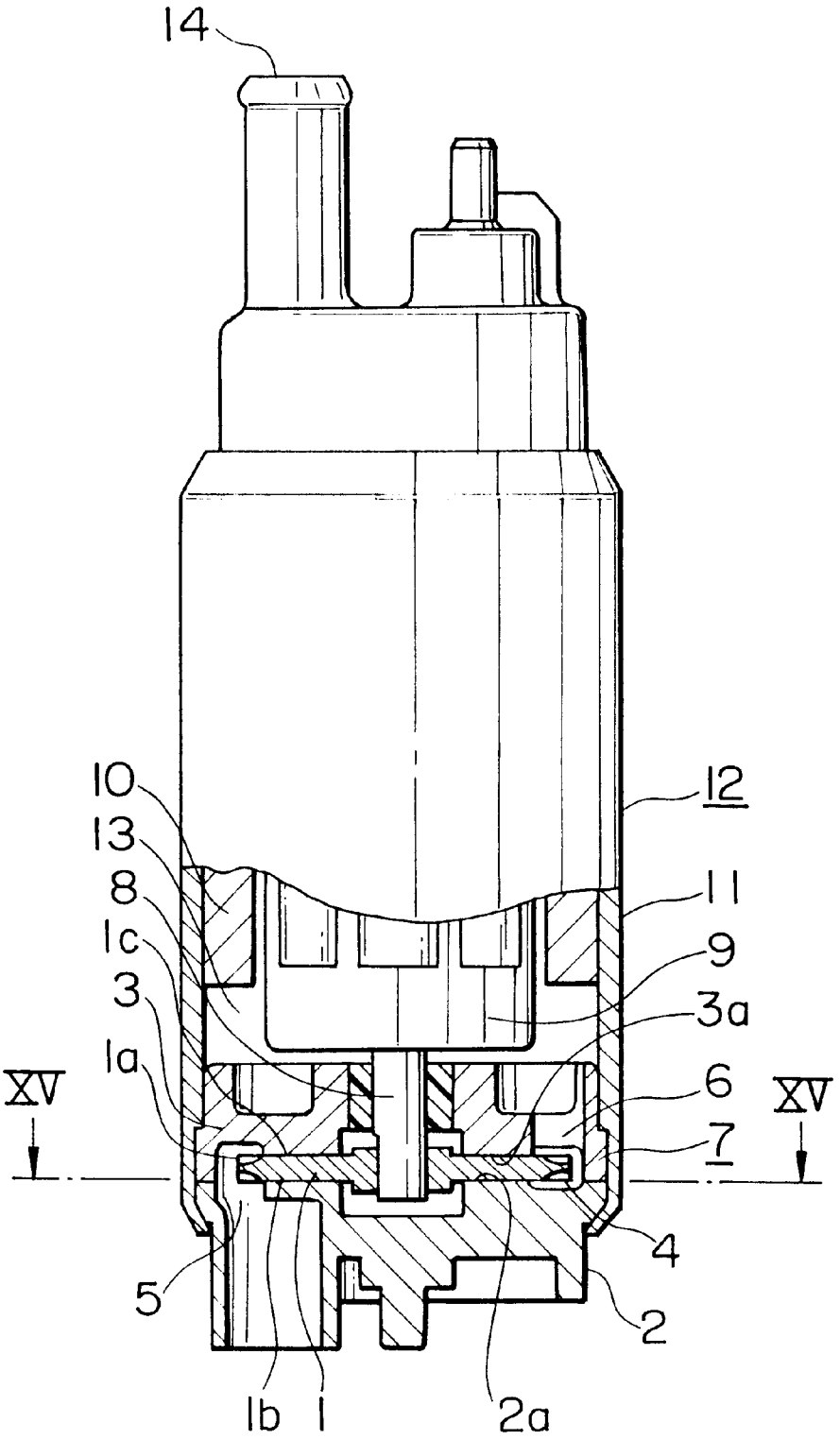
FIG. 14 is a side view showing partly in section a conventional electric fuel pump.
Figure 15:
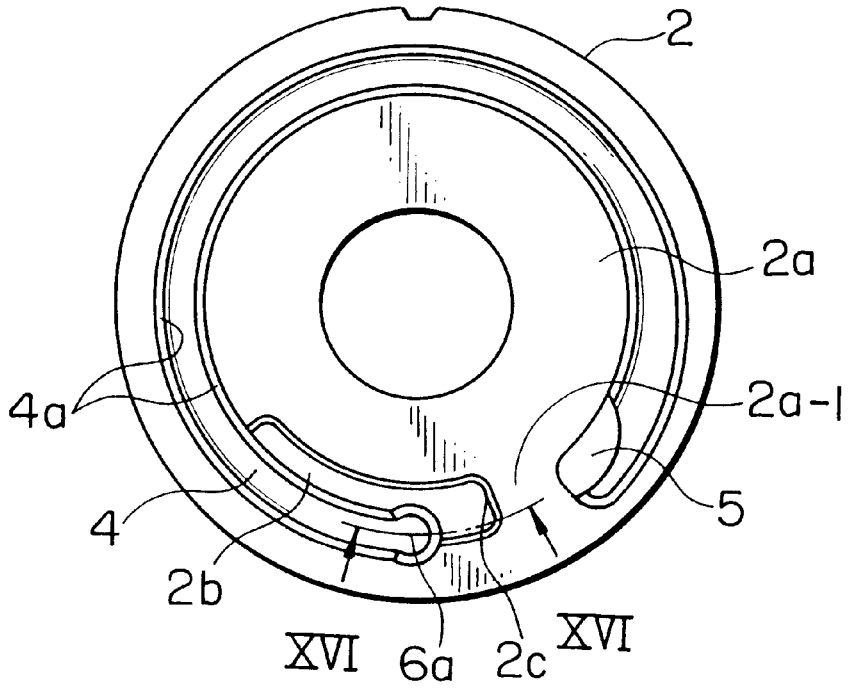
FIG. 15 is a sectional view taken along the line XV—XV of FIG. 14.
Figure 16:
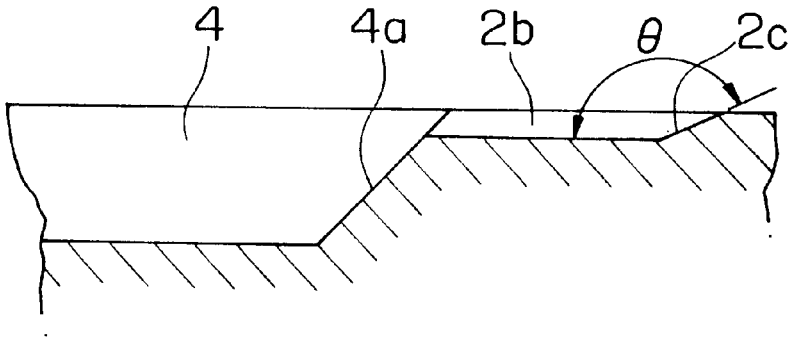
FIG. 16 is a sectional view taken along the line XVI—XVI of FIG. 15.
Figure 17:
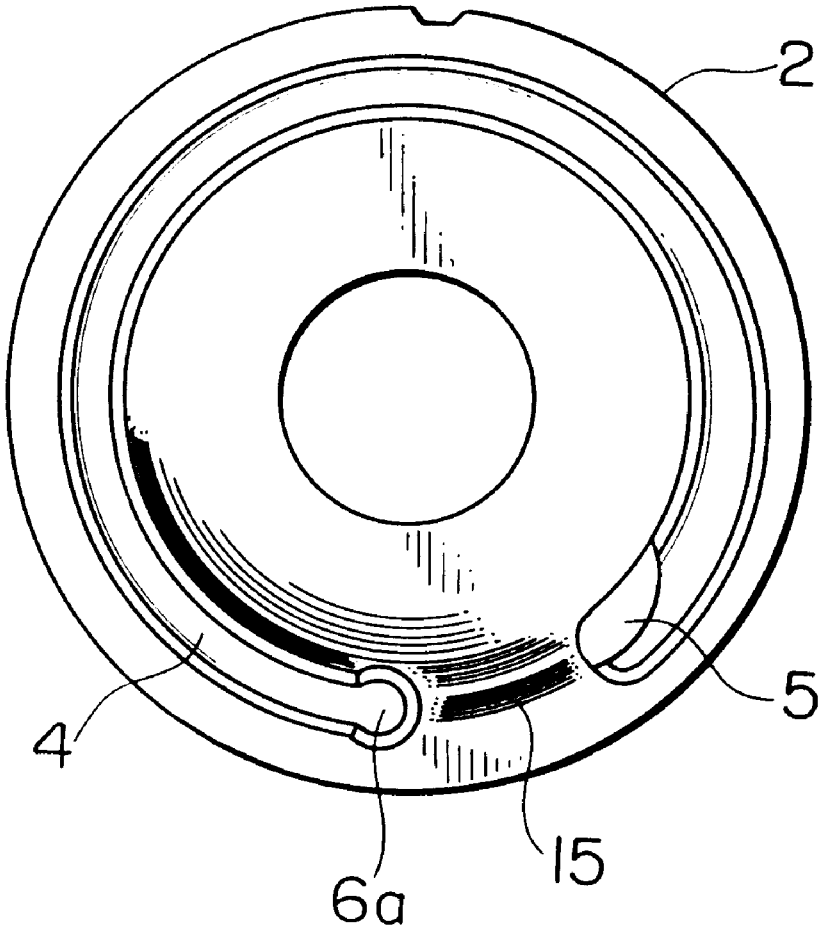
FIG. 17 is a plan view showing for a reference a pump cover in which no abutment relief portion is provided.

FIGS. 12 and 13 are views showing the steps for manufacturing the pump casing of the fifth embodiment of the present invention, FIG. 12 being a view showing the step of machining the pump chamber in the sliding surface of the pump cover constituting the pump casing and FIG. 13 being a view showing the step of machining the abutment relief portion in the sliding surface of the pump cover. In these figures 4, 4*a*, 16 and 16*a* are the components similar to those of the first embodiment, so that their explanation will be omitted.

Next, the manufacturing steps will now be described in detail.

(A) The First Step (see FIG. 12)

40 is a cutter mounted to an unillustrated cutting machine to rotate. The pump chamber 4 of a circular arcuate belt shape (similar to that shown in FIG. 2) is formed in the sliding surface 16*a* of the pump cover 16 constituting the pump casing in a predetermined shape by cutting with the cutter 40. The inner side wall 4*a* of the pump chamber 4 is a formed according to the shape of the tip 40*a* of the cutter 40. In the example shown in FIG. 10, the angle θ1 of the inner side wall 4*a* shown in the fifth embodiment is 135 degrees.

(B) The Second Step (see FIG. 13)

The abutment relief portion 41 and the stepped side wall 41*a* are formed such that the sliding surface 16*a* of the pump cover 16 constituting the pump casing is cut through the use of the cutter 40 having the tip shape 40*a* same as that used in cutting the pump chamber 4 in the above first step to form the abutment relief portion 41 communicated with the pump chamber 4, the angle θ2 of the stepped side wall 41*a* at the end portion of this abutment relief portion 41*b* being the same angle as the angle θ1 of the inner side wall 4*a* of the pump chamber 4.

Also, although the manufacturing step is not illustrated, the stepped side wall 30*a* of the gap portion 30 shown in FIG. 9 as well as the stepped side wall 30*b* shown in FIG. 11 can also be machined by the cutter 40 of the tip shape 40*a* the same as that used in cutting the pump chamber 4, they are formed in the same angle θ1 as the inner side wall 4*a* of the pump chamber 4.

Also, the angle θ1 of the inner side wall 4*a* of the pump chamber 4, the angle θ2 of the stepped side wall 41*a* of the abutment relief portion 41 and the angle of the stepped side walls 30*a* and 30*b* of the gap portion 30 are preferable to be within the range of from 90 degrees to 135 degrees in order to obtain an electric fuel pump of a good discharge efficiency according to the results of the various experiments with different angles of the cutter 40.

It is to be noted that the angle θ1 of the inner side wall 4*a* of the pump chamber 4 and at least one of the angle θ2 of the stepped side wall 41*a* of the abutment relief portion 41 and the angle of the stepped side walls 30*a* and 30*b* of the gap portion 30 may be made an equal angle.

According to the fourth embodiment, the angle θ1 of the inner side wall 4*a* of the pump chamber 4 formed in the sliding surface 16*a* of the pump cover 16 constituting the pump casing and at least one of the angle θ2 of the stepped side wall 41*a* of the abutment relief portion 41 communicated with the pump chamber 4 and the angle of the stepped side walls 30*a* and 30*b* of the gap portion 30 are made equal to each other so that the same cutter 40 used in forming the pump chamber 4 can be used in cutting the abutment relief portion 41 and the gap portion 30, so that time for replacing the special cutter 40 for cutting the abutment relief portion 41 and the gap portion 30 and the cutter 40 becomes unnecessary and the cutting time for the pump casing can be shortened, making the manufacture easy.

This invention, with the above-described structure, has the following advantageous results.

According to the electric fuel pump of this invention, the provision is made, in a pump casing disposed in opposition to the opposite side surfaces of said impeller with a small gap therebetween to define a sliding surface supporting said impeller, of an abutment relief portion which is disposed at the inner circumference side of said pump chamber in the vicinity of the side opposing to said pump chamber outlet, said abutment relief portion having a gap larger than said small gap, and a stepped side wall defined at an end portion downstream of the side of said abutment relief portion opposing to said pump chamber outlet, so that the contact between the impeller and the sliding surface of the pump casing can be alleviated, decreasing the rotational frictional resistance of the impeller, reducing the lowering of the rotation of the motor portion, decreasing the current consumption and resulting in an electric fuel pump of a high discharge efficiency.

Also, the inner circumference of said abutment relief portion has a configuration such that, in the direction of rotation of said impeller, the radius from the rotational center of said impeller gradually increases and that a stepped side wall is provided at the end portion of the inner circumferential side of said abutment relief portion, so that the pressure generation effect similar to that of the first embodiment can be obtained even at the inner circumferential side, allowing the impeller to be more effectively lift away from the sliding surface, alleviating the contact between the pump casing and the impeller and further decreasing the rotational frictional resistance.

Also, a gap larger than said small gap is defined in the vicinity of said fuel suction port of said sliding surface on the side opposing to said pump chamber outlet of said pump casing and wherein a stepped side wall is disposed in the gap at the end portion downstream of a starting end portion of said pump chamber, so that the impeller can be more effectively lift away from the sliding surface, alleviating the contact between the pump casing and the impeller and further decreasing the rotational frictional resistance.

Also, the configuration of the inner circumference of said abutment relief portion is such that, in the direction of rotation of said impeller, the radius from the rotational center of said impeller gradually increases and that a stepped side wall is provided at the end portion of the inner circumferential side of said abutment relief portion, so that allowing the impeller to be more effectively lifted away from the sliding surface even at the inner circumferential side, alleviating the contact between the pump casing and the impeller and further decreasing the rotational frictional resistance.

Furthermore, the angle of the inner side wall of the arcuate belt-shaped pump chamber disposed in said pump casing and the angle of at least one of the stepped side walls of said abutment relief portion and said gap portion are the same angles, so that, since the same cutter used in forming the pump chamber of the pump casing can be used in cutting the abutment relief portion of the pump casing, the time for replacing the cutter is unnecessary and the cutting time for the pump casing can be shortened, making the manufacture easy.

What is claimed is:

1. An electric fuel pump, comprising:

an impeller having a vane groove portion at its outer circumferential portion of a discshape;

a motor portion for rotation-driving said impeller;

a pump casing disposed in opposition to the opposite side surfaces of said impeller with a small gap therebetween to define a sliding surface supporting said impeller, defining an arcuate belt-shaped pump chamber extending along the outer circumferential portion of said impeller around said sliding surface and having a fuel suction port at one end portion of said arcuate belshaped chamber and a pump chamber outlet at the other end portion;

an abutment relief portion disposed in said pump casing at the inner circumference side of said pump chamber in the vicinity of the side opposing said pump chamber outlet, said abutment relief portion having a gap larger than said small gap;

a dam portion of said pump casing, disposed between said pump chamber outlet and said fuel suction port, wherein said abutment relief portion is not provided for at least some of said dam portion; and means for creating hydraulic pressure in a direction perpendicular to a rotational direction of said impeller, thereby preventing said impeller from scraping said dam portion, wherein said means comprises an abrupt side wall defined at an end portion downstream of the side of said abutment relief portion opposing said pump chamber outlet.

2. An electric fuel pump as claimed in claim 1, wherein the inner circumference of said abutment relief portion has a configuration such that, in the direction of rotation of said impeller, the radius from the rotational center of said impeller gradually increases and that an abrupt side wall is provided at the end portion of the inner circumferential side of said abutment relief portion.

3. An electric fuel pump as claimed in claim 1 or 2, wherein a gap larger than said small gap is defined in the vicinity of said fuel suction port of said sliding surface on the side opposing said pump chamber outlet of said pump casing and wherein an abrupt side wall is disposed in the gap at the end portion downstream of a starting end portion of said pump chamber.

4. An electric fuel pump as claimed in claim 3, wherein the inner circumference of said abutment relief portion is such that, in the direction of rotation of said impeller, the radius from the rotational center of said impeller gradually increases.

5. An electric fuel pump as claimed in claim 4, wherein a stepped side wall is provided at the end portion of the inner circumferential side of said abutment relief portion.

6. An electric fuel pump as claimed in claim 1, wherein the angles of the inner side wall of the arcuate belt-shaped pump chamber disposed in said pump casing and the angle of the abrupt side wall of said abutment relief portion is the same.

7. An electric fuel pump as claimed in claim 5, wherein the angles of the inner side wall of the arcuate belt-shaped pump chamber disposed in said pump casing and the angle of at least one of the abrupt side walls of said abutment relief portion and said gap portion in the vicinity of said fuel suction port are the same.

8. An electric fuel pump as claimed in claim 1, wherein said abrupt side wall forms an angle of 90°–135° with respect to a bottom surface of said abutment relief portion.

9. An electric fuel pump as claimed in claim 4, wherein the inner circumference of said gap in the vicinity of said fuel section port has a configuration such that, in the direction of rotation of said impeller, the radius from the rotational center of said impeller gradually increases and that an abrupt side wall is provided at the end portion of the inner circumferential side of said gap in the vicinity of said fuel section port.

* * * * *